US007163183B2

(12) United States Patent
Sutherland et al.

(10) Patent No.: US 7,163,183 B2
(45) Date of Patent: Jan. 16, 2007

(54) BOW HOLDER

(75) Inventors: Warren E. Sutherland, Louisa, KY (US); Roy G. Mollette, Tomahawk, KY (US)

(73) Assignee: Inspired and Created Concepts, LLC, Louisa, KY (US)

( * ) Notice: Subject to any disclaimer, the term of this patent is extended or adjusted under 35 U.S.C. 154(b) by 94 days.

(21) Appl. No.: 11/038,664

(22) Filed: Jan. 19, 2005

(65) Prior Publication Data

US 2005/0178938 A1 Aug. 18, 2005

Related U.S. Application Data

(60) Provisional application No. 60/537,776, filed on Jan. 20, 2004.

(51) Int. Cl.
*A47F 5/00* (2006.01)

(52) U.S. Cl. ..... 248/309.1; 124/23.1

(58) Field of Classification Search ..... 248/205.1, 248/218.4, 220.21, 222.52, 316.1, 309.1
See application file for complete search history.

(56) References Cited

U.S. PATENT DOCUMENTS

| | | | | |
|---|---|---|---|---|
| 2,890,847 | A * | 6/1959 | Minton et al. | 248/534 |
| 3,783,548 | A * | 1/1974 | Fisher | 43/21.2 |
| 4,230,296 | A | 10/1980 | Staley et al. | |
| 4,360,179 | A | 11/1982 | Roberts | |
| 4,542,873 | A | 9/1985 | Matherly et al. | |
| 4,729,363 | A | 3/1988 | Skyba | |
| D299,199 | S | 1/1989 | Rogowski | |
| 4,896,854 | A | 1/1990 | St. Laurent | |
| 4,936,415 | A | 6/1990 | Williams | |
| 5,044,590 | A | 9/1991 | Carafice | |
| 5,405,125 | A | 4/1995 | Gartland | |
| 5,465,933 | A | 11/1995 | Todd | |
| 5,482,241 | A | 1/1996 | Oglesby | |
| D371,416 | S * | 7/1996 | Bliss | D22/107 |
| 5,727,760 | A | 3/1998 | Wytovak et al. | |
| 5,775,658 | A | 7/1998 | Englehardt | |
| 5,941,484 | A | 8/1999 | Stepney, III et al. | |
| 6,021,768 | A | 2/2000 | Pomaville | |
| D422,333 | S | 4/2000 | Foster et al. | |
| 6,131,556 | A | 10/2000 | Villarreal | |
| 6,244,556 | B1 | 6/2001 | Carrillo et al. | |
| 6,484,913 | B1 * | 11/2002 | Hancock et al. | 224/401 |
| 6,679,465 | B1 * | 1/2004 | Leasure | 248/229.15 |

* cited by examiner

*Primary Examiner*—Ramon O Ramirez
(74) *Attorney, Agent, or Firm*—Emch, Schaffer, Schaub & Porcello, Co., L.P.A.

(57) ABSTRACT

A bow holder for holding an archery bow when the bow is not being used while hunting. This base can be used on multiple type tree stands either vertically or horizontally depending on the tree stand used. The connection between the main base parts and wire holder allows a 360-degree pivot of the holder, which makes the bow more accessible for the hunter. The holder secures the bow from falling or being knocked off or out of its holder, but the bow holder also allows the bow to be easily taken by the hunter by simply tilting the bow toward the hunter and lifting the bow out of the holder.

5 Claims, 5 Drawing Sheets

BOW HOLDER

CROSS REFERENCE TO RELATED APPLICATIONS

This application claims the benefit of U.S. provisional patent application Ser. No. 60/537,776 filed Jan. 20, 2004.

BACKGROUND OF THE INVENTION

The present invention is generally directed to a hunting concept. More particularly the invention is a holder for a bow that makes the bow more secure and more easily accessible for the hunter. In addition the holder also has a 360-degree pivot, which allows the holder to accommodate the different positions and needs of the hunter. With this pivot ability the holder can be used to accomplish multiple positioning at arms length on most tree stands. By using the weight of the bow against the wire holder rest the bow becomes secure and by design of the wire holder prevents the bow from being knocked out of the holder. Before the present invention, bow holders had to be permanently bolted on the tree stand; in addition, a holder that worked on one tree stand may not work on another tree stand. The bow also could easily fall from the holder simply by bumping the bow or jiggling the tree stand. The only other option available was for the hunter to hold the bow on his lap the entire time he was hunting.

SUMMARY OF THE INVENTION

The present invention is directed to a bow holder that holds an archery bow. The holder attaches to multiple types of tree stands. The bow holder has a 360-degree pivot, which makes the bow more easily accessible to the hunter. Since the bow is held securely in the holder by its own weight, the arrow can be knocked or positioned in the bow ready to be shot while the bow is placed in the holder making the bow ready for use. This leaves the hunter's hands free for safety purposes and for calling game or using other equipment. By making the hunter more comfortable, this will minimize the movements made by the hunter, which will result in a more successful hunt.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
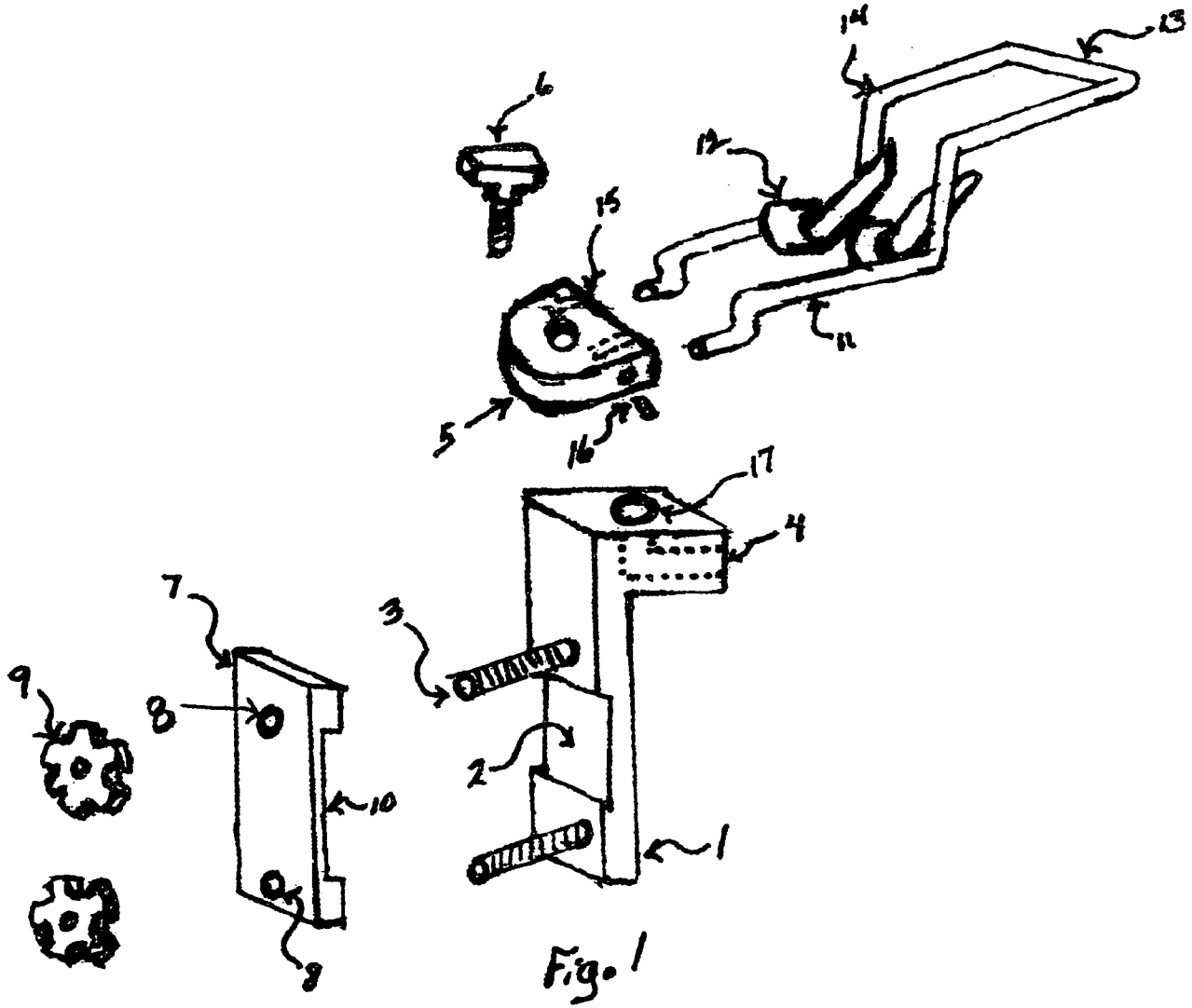
FIG. 1 is an exploded perspective view of the bow holder of the present invention.

The present invention is generally directed to a hunting bow holder concept. More particularly the holder is designed to be securely fastened to a variety of types of tree stands enabling the hunter more versatility and easier access to the bow. The features of the holder will be more fully understood by referring to the attached drawings in connection with the following description.

As shown in FIGS. 1–5 the holder has an L-shaped base 1 that is adaptable to multiple tree stands. The L-shaped base 1 consists of a groove 2, studs 3 and threaded aperture 4 and 17. The groove 2 acts as a lock to stop any slippage when tightened to the stand by the use of two studs 3. The base clamping bar 7 consist of two apertures 8 and a groove 10. The two apertures 8 allow the studs 3 on the L-shaped base/to be inserted through the bar for clamping by two threaded knobs 9. By attaching the L-shaped base 1 to the base clamping bar 7, with the knobs 9, this gives a tight and secure connection to a tree stand. This connection also makes removal of bow holder from a tree stand simple and easy, by simply loosening and removing the knobs 9. The groove 10 is also used as a locking device to prevent slippage. The threaded apertures 4 or 17 are used, depending on the type of tree stand used, to connect the wire holder base 5 to the L-shaped base 1 with the tightening bolt 6.

Figure 2:
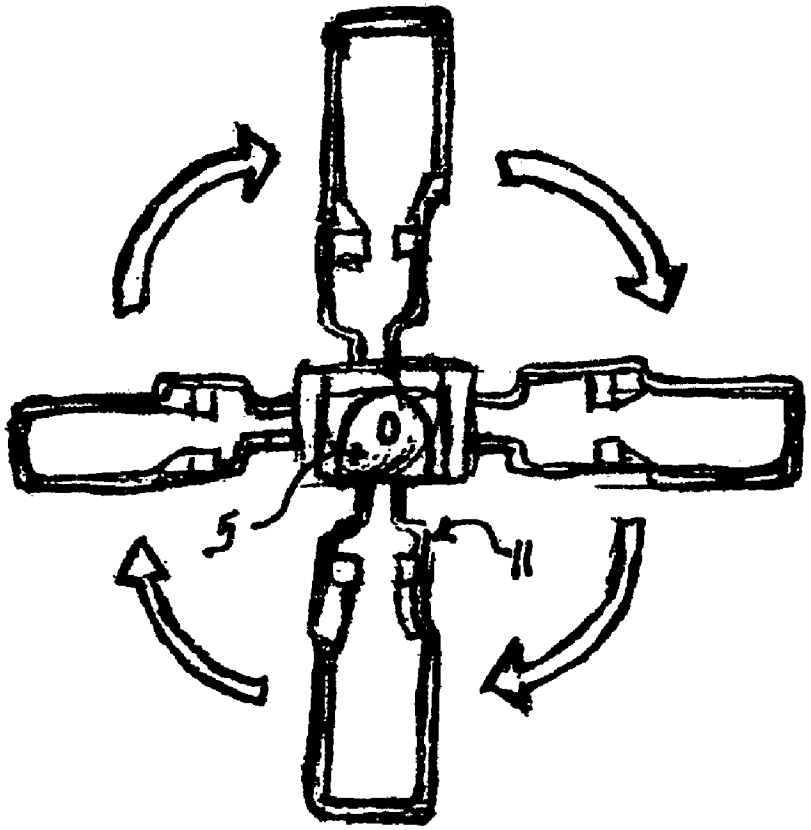
FIG. 2 shows the top view of the 360-degree pivot ability of the present invention.

The L-shaped base 1, allows one of the two treaded apertures 4 or 17 to accept the tightening bolt 6 to connect and tighten the wire holder base 5 to the L-shaped base 1. The tightening bolt 6 can be loosened then tightened to give a 360-degree pivot, as shown in FIG. 2 to the wire holder base 5. The bow supporting wire 11 is inserted in two apertures 15 in the wire holder base 5 and held in place with two locking bolts 16. The holder can be positioned in any desired location to make the bow easily accessible.

Figure 3:
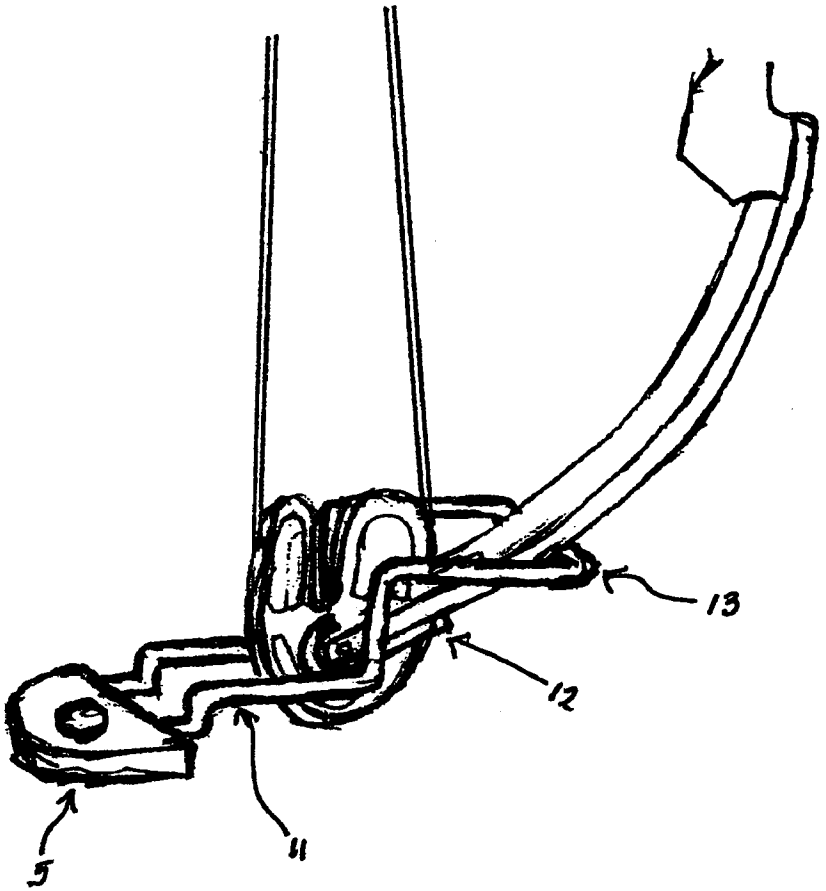
FIG. 3 is a partial perspective view of bow inserted in the holder of the present invention.

As shown in FIGS. 1 and 3, the hooks 12 on the bow supporting wire 11 are designed to accept the limb of any bow or compound bow by inserting the limbs down in to the hooks 12. When the limbs are inserted into the hooks 12, the weight of the bow is then leaned back into the wire holder rest 13. The wire bend 14 helps cradle the bow when the bow is lowered into the wire holder 11. The combination of the weight of the bow, the hooks 12, the rest 13 and the bend 14 creates a locking system that prevents the bow from slipping or being knocked out of the holder. By leaning the bow onto the wire holder rest 13 the bow virtually holds itself in the wire holder 11 with its own weight. The design of the wire bow holder bend 14 makes the holder almost impossible for the bow to be knocked out of the holder by pulling the bow away from the wire bend 13, the bow is easily released from the holder.

Figure 4:
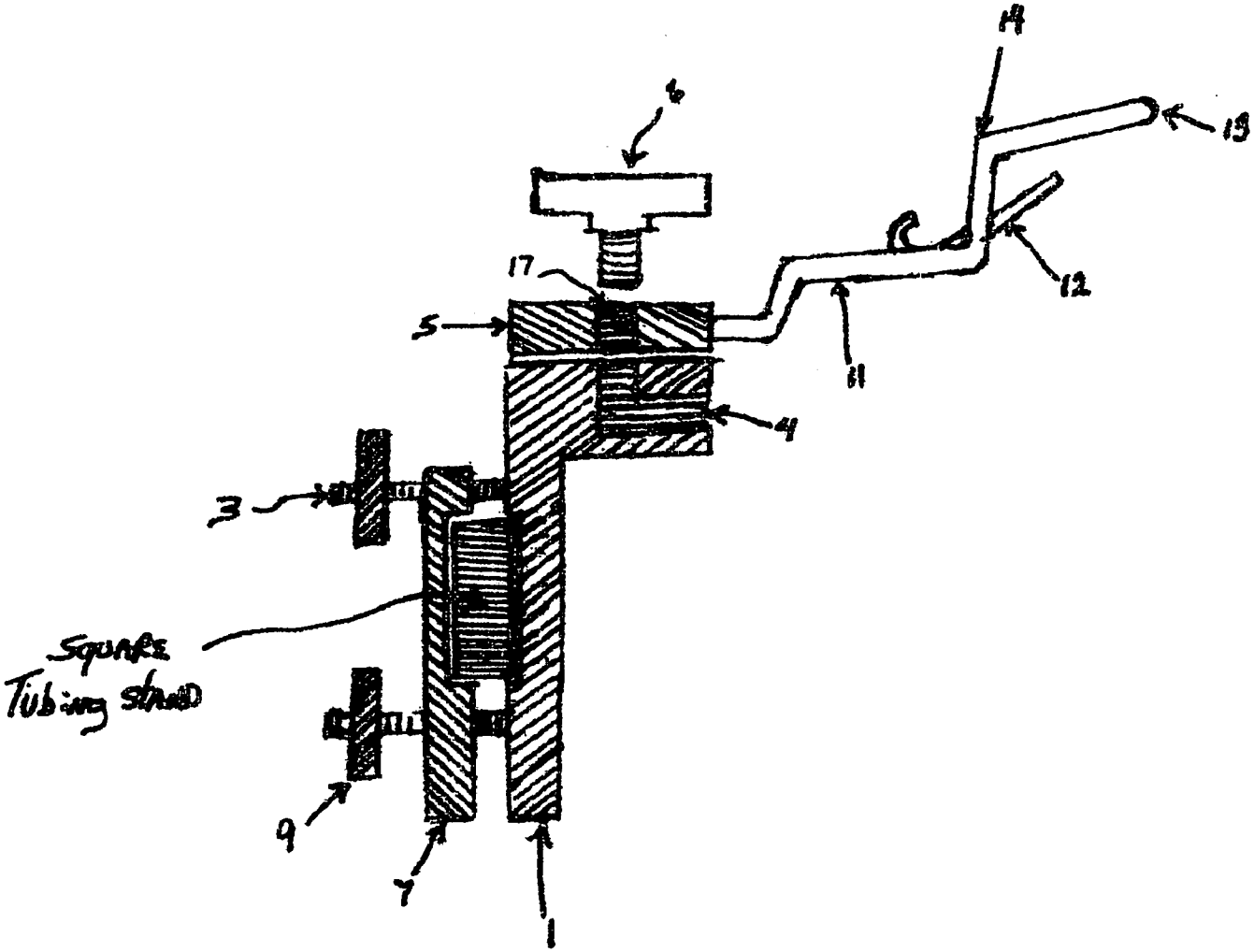
FIG. 4 is a partial cross-sectional, side elevation view of the upright position of the present invention.
Figure 5:
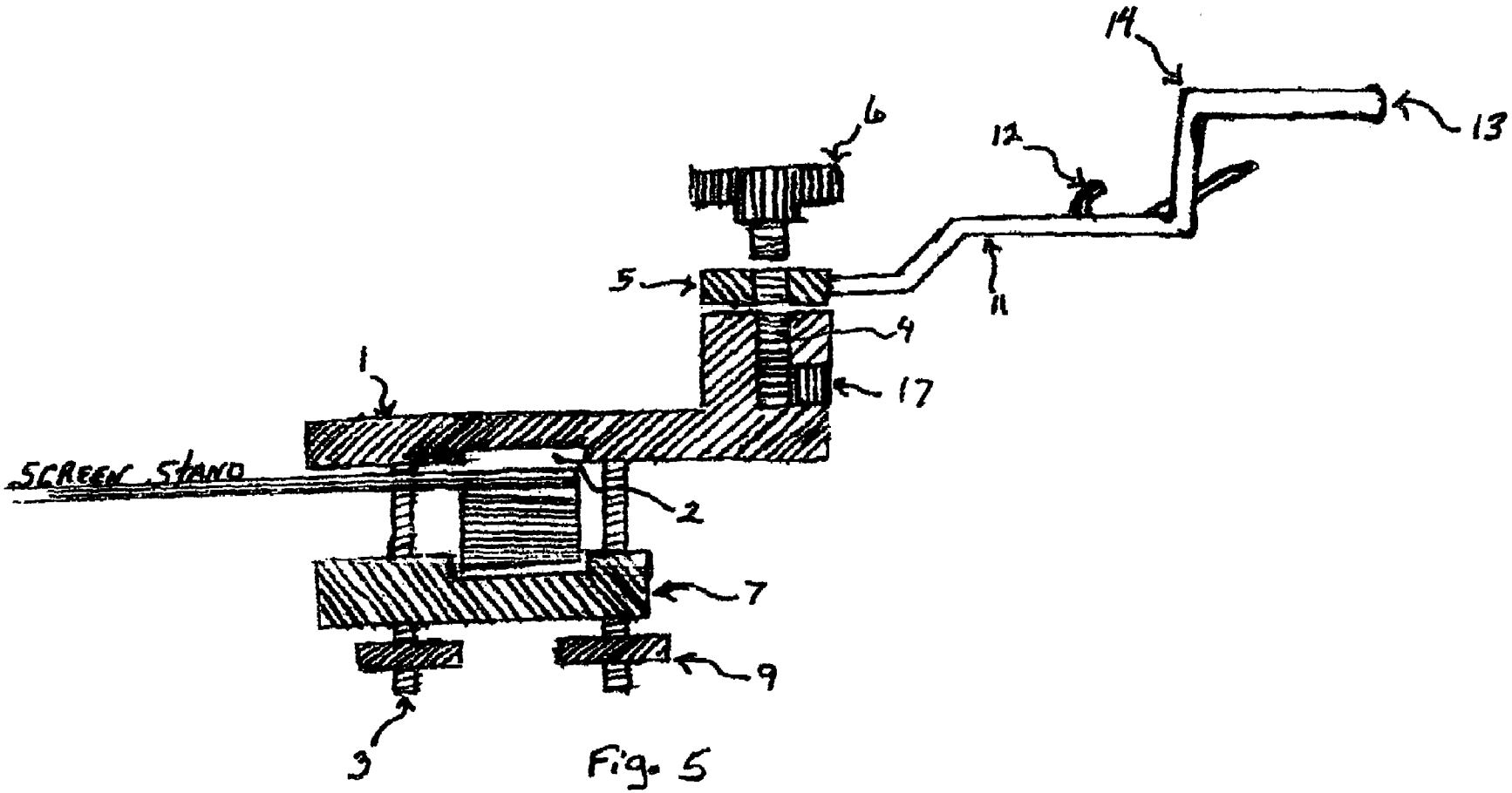
FIG. 5 is a partial cross-section, side elevation view of the lying flat position of the present invention.

The L-shaped base 1 is designed to be used in an upright position as shown in FIG. 4, by using the treaded aperture 17 or in a lying flat position as shown in FIG. 5, by using threaded aperture 4. By using the holder in different positions, this allows the holder to be used on multiple type stands. This gives versatility to the hunter.

The above description of the invention is given for explanatory purposes. Various modifications, changes and substitutions can be made without departing from the scope of the invention as defined by the following claims.

We claim:

1. A bow holder comprising:

a clamping bar for releasably securing the holder to a stand; the clamping bar having a groove that is disposed for engaging the stand;

an L-shaped base operatively connected to the clamping bar; the L-shaped base having a groove that is disposed in opposing relationship with the groove in the clamping bar, the groove in the L-shaped base being disposed for engaging the stand; and a wire holder connected to the L-shaped base, the wire holder including a rest and hooks positioned on the wire holder whereby the hooks engage an end of a limb of the bow and the rest of the wire holder engages a portion of the limb of the bow that is spaced apart from the end of the limb to secure the bow in the holder.

2. The bow holder of claim 1 wherein the clamping bar and L-shaped base are releasable secured to one another to secure the bow holder to a stand.

3. The bow holder of claim 1 wherein the wire holder is pivotally secured to the L-shaped base.

4. The bow holder of claim 3 wherein the wire holder can be rotated with respect to the L-shaped base to position the wire holder in the desired position.

5. The bow holder of claim 1 wherein the weight of the bow assists in retaining the bow in the bow holder.

* * * * *